US005396854A

United States Patent [19]

Noqueras

[11] Patent Number: 5,396,854

[45] Date of Patent: Mar. 14, 1995

[54] METHOD FOR HANDLING AND SEWING THE PERIMETER OF UPHOLSTERED ARTICLES

[75] Inventor: Jose L. A. Noqueras, Madrid, Spain

[73] Assignee: Fabricas Lucia Antonio Betere, S.A., Madrid, Spain

[21] Appl. No.: 88,873

[22] Filed: Jul. 8, 1993

[30] Foreign Application Priority Data

Jun. 18, 1993 [ES] Spain ..... 9301374

[51] Int. Cl.[6] ..... D05B 27/00

[52] U.S. Cl. ..... 112/262.3; 112/309

[58] Field of Search ..... 112/2.1, 308, 309, 303; 198/341, 718, 740

[56] References Cited

U.S. PATENT DOCUMENTS

| | | | |
|---|---|---|---|
| 1,653,648 | 12/1927 | Malocsay | 198/740 X |
| 3,590,975 | 7/1971 | Hollenton | 198/740 X |
| 3,797,423 | 3/1974 | Lopez et al. | 198/341 X |
| 4,958,579 | 9/1990 | De Weers | 112/2.1 |
| 5,186,596 | 2/1993 | Boucher et al. | 198/748 X |
| 5,216,969 | 6/1993 | Thomas et al. | 112/7 |

FOREIGN PATENT DOCUMENTS

| | | | |
|---|---|---|---|
| WO9212282 | 7/1992 | WIPO | 112/2.1 |

*Primary Examiner*—Clifford D. Crowder
*Assistant Examiner*—Paul C. Lewis
*Attorney, Agent, or Firm*—Peter L. Michaelson; Jeffery J. Brosemer

[57] ABSTRACT

A method for handling and sewing the perimeter of upholstered articles, in which the upholstered article is fed through the sewing machine on a table with a sliding surface in one of whose sides the said sewing machine is fixed, which is characterized by having some pusher elements which protrude from the plane of the table through some longitudinal and circumference arch shaped grooves, which are driven from the lower part of said table. The longitudinal pushers assist the linear feed of the upholstered article until its corner reaches the height of the sewing machine, when they withdraw to their initial position, at the same time as the turning pushers start to work. These turning pushers make the upholstered article turn, describing a circumference arch path of ninety degrees, while the head of said sewing machine sews the corner of said upholstered article in a synchronized manner. When the turn has been completed, the turning pushers withdraw to their initial position and the previous longitudinal pushers start to work.

14 Claims, 1 Drawing Sheet

METHOD FOR HANDLING AND SEWING THE PERIMETER OF UPHOLSTERED ARTICLES

OBJECT OF THE INVENTION

The object of this Patent of Invention application is a method for handling and sewing the perimeter of upholstered articles which offers outstanding advantages and innovations compared with systems currently used with the same or similar purpose.

BACKGROUND OF THE INVENTION

At the present time, and with reference to the state of the art, it should be mentioned that European Patent number 8920041,6 for "A device for sweing mattresses or pillows" is known, which is designed to sew the edges of a mattress and consists of a moving supporting surface, a sewing machine and an oscillating arm which assists the securing elements in turning the mattress around one of its corners. The device also has sensors to detect the position of the mattress, as well as control means for activating the oscillating arm, driven pneumatically, which depends on the signals emitted by said sensors.

Patent of Invention number 9100056 for "A system for sewing upholstered articles" is also known, of the same applicants which consists of a reducer motor with speed variator related with some shafts through a transmission system, in association with a conveyor belt on which a mattress, or similar, is placed, on which a sewing machine operates, adapted to the assembly of which it forms part; three sewing speeds have been foreseen, operating according to the area of the mattress being sewn through information from some sensors, such as photoelectric cells; the highest speed is for sewing straight stretches, the other slower speed to the end of these stretches approaching the curves, and the third speed is for sewing the curves. It also has an arm driven by the same single motor to turn the mattress when the curves are being sewn.

DESCRIPTION OF THE INVENTION

The method for handling and sewing the perimeter of upholstered articles, object of this invention, has been designed to obtain an automatic system for sewing the perimeter of upholstered articles, offering better technical performance and greater construction and functional simplicity than current sewing systems, which it surpasses, apart from improving the quality of sewing.

In the method proposed, the upholstered article is placed on the sewing machine, which is fixed to a table with a sliding surface to assist moving the article, in one of whose sides the sewing machine is fixed.

Alternatively, the sliding surface could be replaced in all or in part, by a roller assembly, placed perpendicularly to the side of the Lable in which the sewing machine is located.

The upholstered element moves forward through the effect of some pusher elements, normally two or more, which protrude from the plane of the table, through some longitudinal grooves. These pushers are driven from the lower part of the table and advance until the corner of the upholstered article reaches a height of the sewing machine, then withdrawing to their initial position.

When the upholstered article reaches the position in which its corner enconters the sewing machine, other pushers located in the side of the table, which protrude from the plane of the latter through some roughly circumference arch shaped grooves, also driven from the lower part of the table, will make the upholstered article turn, describing a circumference arch path of approximately 90 or 100 degrees, while the head of the sewing machine sews the corner of the upholstered article, generally round, in a synchronised manner. When the turn has been completed, these pushers withdraw to their initial position and the pushers which operate longitudinally start to work again.

To ensure that the upholstered article turns perfectly, a tamping bar driven by a pneumatic piston, near the turning angle, can be incorporated.

The longitudinal pushers will be driven by an element placed under the plane of the table, which will move along some guides, belts or the like, parallel to the side of said table in which the sewing machine is located.

The turning pushers will be driven by an element, also placed under the plane of the table.

The element which supports the turning pushers can be driven alternatively by a guide shaped basically like a circumference segment and the combination of rack and pinion.

To complete the description to be made below and in order to assist a better understanding of its features, a set of drawings is attached to this descriptive report, in whose figures the most significant details of the invention are shown, in an illustrative and not limiting manner.

DESCRIPTION OF A PREFERRED EMBODIMENT

Figure 1:
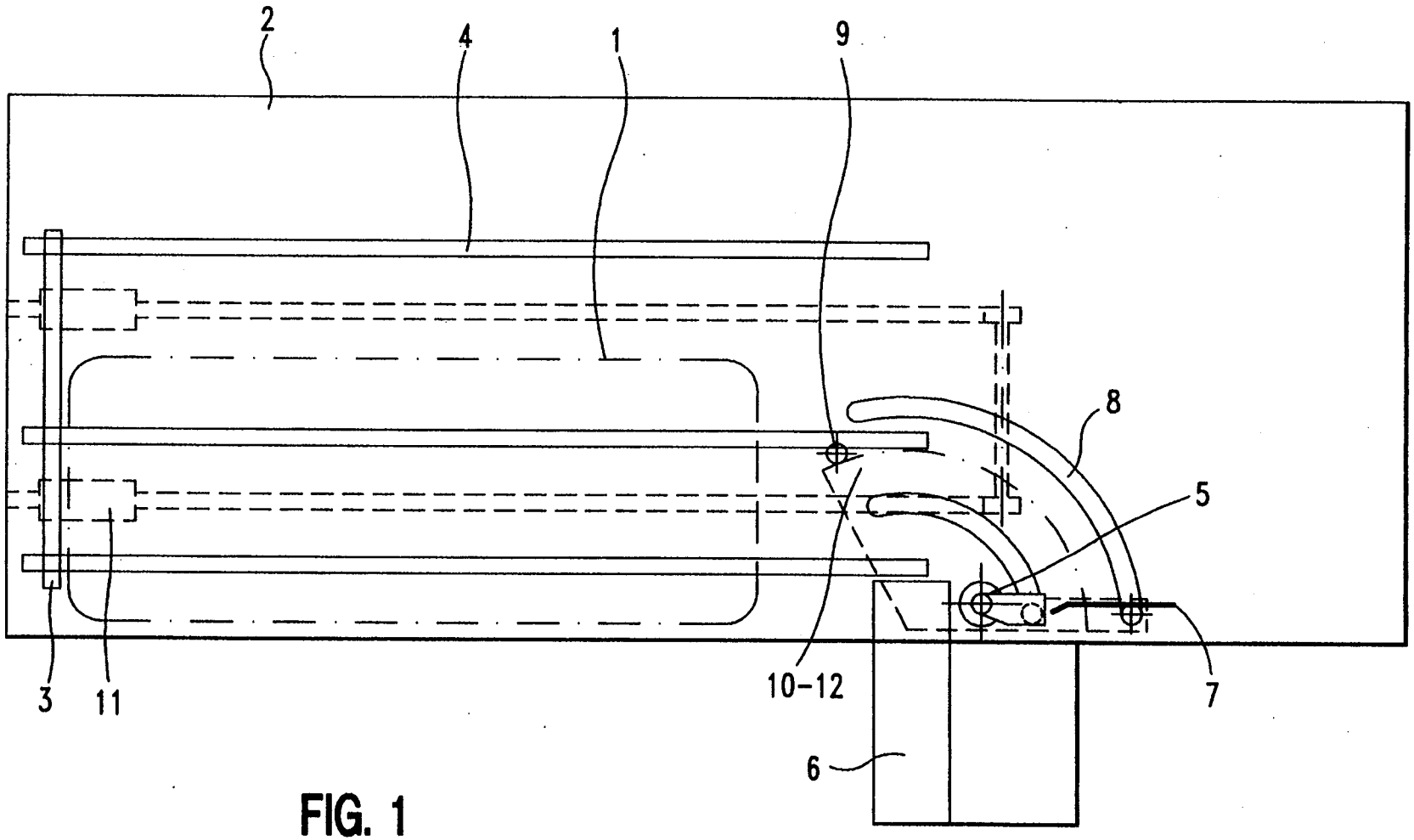
FIG. 1. Shows a diagramatic plan view of the invention assembly.

In the light of the figure mentioned and in accordance with the numbering adopted, in its embodiment a sliding table 2 can be observed, in one of whose sides a sewing machine 6 is fixed.

Alternatively, the sliding surface can be replaced totally or partially by a set of rollers placed perpendicularly to the side of the table in which the sewing machine 6 is placed.

The system consists in that an upholstered article advances through the effect of some pusher elements 3 which protrude from the plane of the table through some longitudinal grooves 4. These pushers 3 are driven from the lower part of the table and advance until the corner of the upholstered article 1 reaches the height of the sewing machine 6, when they withdraw to their initial position.

When the upholstered article 1 is in the position in which its corner is opposite the sewing machine 6, other pushers 7 located in the side of the table, which protrude from the plane of the latter through some circumference arch shaped grooves 8, and also driven from the lower part of the table, will make the upholstered article 1 turn, describing a circumference arch path of ninety degrees, at the same time as the head of the sewing machine 6 sews the corner of the upholstered article 1 in a synchronised manner.

Once the turn has been completed, these pushers 7 withdraw to their initial position and the former longitudinal pushers 3 come into operation.

In order to ensure that the upholstered article 1 turns perfectly, a tamping bar 5 driven by a pneumatic piston, near the turning angle, can be incorporated.

The longitudinal pushers 3 are driven by an element 11 placed under the plane of the table, which will move through some guides, belts or the like, parallel to the side of said table in which the sewing machine 6 is located.

The turning pushers 7 will be driven by an element 12, also placed under the plane of the table.

Alternatively, the turning pushers may be driven by an element activated through a rack 10, and pinion 9.

I claim:

1. A method for sewing a perimeter seam of an upholstered workpiece comprising the steps of:

(a) moving a first pusher element which protrudes from a longitudinal groove in a table having a planar, sliding surface from an initial position along said groove such that said first pusher element contacts an upholstered workpiece positioned upon said planar surface of said table;

(b) moving said first pusher element along a length of said groove in a rectilinear direction such that said upholstered workpiece is moved in a rectilinear direction beneath a sewing machine located adjacent said table;

(c) sewing a seam in said upholstered workpiece as said upholstered workpiece moves beneath said sewing machine;

(d) moving said first pusher element to its said initial position when a corner of said upholstered workpiece reaches said sewing machine;

(e) moving a second pusher element, which protrudes from an arcuate groove in said table and initially positioned adjacent one side of said table, in an arcuate path while said second pusher element contacts said upholstered workpiece such that said upholstered workpiece is turned in an arcuate path away from said sewing machine and towards said table in a counter-clockwise direction; and (f) sewing a corner seam in said upholstered workpiece while said workpiece is being turned by said second pusher element.

2. The method of claim 1 further comprising the steps of:

(g) moving said second pusher element to its initial position; and repeating steps a through g until a continuous seam is sewn in all corners and sides of said upholstered workpiece.

3. The method of claim 1 wherein the upholstered workpiece is turned substantially ninety degrees by said second pusher element in an arcuate path away from said sewing machine and towards said table in a counter-clockwise direction.

4. The method of claim 1 further including the steps of:

(h) driving a tamping bar attached to said second pusher element towards said table to engage said upholstered workpiece at a point in axial alignment with said tamping bar such that said workpiece moves coincidentally with said second pusher element; and repeating steps a through h until a continuous seam is sewn in all corners and sides of said upholstered workpiece.

5. The method of claim 1 wherein the first pusher element is driven by an element placed under the planar surface of said table.

6. A method for sewing a perimeter seam of an upholstered workpiece, according to claim 1, wherein the second pusher element is driven by an element placed under the planar surface of the table.

7. A method for sewing a perimeter seam of an upholstered workpiece, according to claim 6, wherein the element driving the second pusher element can be activated through a rack and pinion.

8. Apparatus for sewing a perimeter seam of an upholstered workpiece comprising:

a table having a planar, sliding surface;

a sewing machine located adjacent one side of said table;

a first pusher element that protrudes through grooves in said planar surface of said table such that said first pusher element contacts an upholstered workpiece positioned upon said planar surface of said table;

means for driving said first pusher element from an initial position along a length of said grooves in a rectilinear direction such that said upholstered workpiece is moved in a rectilinear direction beneath said sewing machine while a seam is sewn in said upholstered workpiece; and means for driving a second pusher element that protrudes through an arcuate groove in said planar surface of said table, initially positioned adjacent one side of said table, in an arcuate path while said second pusher element contacts said upholstered workpiece such that a corner seam in said upholstered workpiece is sewn while said upholstered workpiece is being turned in an arcuate path away from said sewing machine and towards said table in a counter-clockwise direction by said second pusher element.

9. The apparatus of claim 8 further comprising:

means for driving said second pusher element to its said initial position; and means for driving said first pusher elements to its said initial position.

10. The apparatus of claim 8 wherein the upholstered workpiece is turned substantially ninety degrees by said second pusher element in an arcuate path away from said sewing machine and towards said table in a counter-clockwise direction.

11. The apparatus of claim 8 further comprising means for driving a tamping bar to engage said upholstered workpiece at a point in axial alignment with said tamping bar so that said upholstered workpiece moves coincidentally with said second pushing element.

12. The apparatus of claim 8 wherein said means for driving said first pusher element is located beneath the planar surface of said table.

13. The apparatus of claim 8, wherein said means for driving said second pusher element is located beneath the planar surface of said table.

14. The apparatus of claim 13, wherein the means for driving said second pusher element is activated through a rack and pinion.

* * * * *